United States Patent [19]

Kitutaka

[11] 4,097,957

[45] Jul. 4, 1978

[54] AUTOMATIC DOOR CLOSING DEVICE

[75] Inventor: Hiromu Kitutaka, Fuchu, Japan

[73] Assignee: Ryobi, Ltd., Fuchu, Japan

[21] Appl. No.: 833,612

[22] Filed: Sep. 15, 1977

[30] Foreign Application Priority Data

Sep. 16, 1976 [JP] Japan ..... 51-124936[U]

[51] Int. Cl.[2] ..... E05F 3/14; E05F 3/22

[52] U.S. Cl. ..... 16/58; 16/49

[58] Field of Search ..... 16/48.5, 49, 58, 66, 16/82, 84; 49/137

[56] References Cited

U.S. PATENT DOCUMENTS

| | | | |
|---|---|---|---|
| 1,970,008 | 8/1934 | Larson | 16/58 |
| 3,038,195 | 6/1962 | Bardfeld | 16/49 |
| 3,267,513 | 8/1966 | Wartian | 16/84 |
| 3,680,171 | 8/1972 | MacDonald | 16/58 |

*Primary Examiner*—Ronald Feldbaum

*Attorney, Agent, or Firm*—Sughrue, Rothwell, Mion, Zinn and Macpeak

[57] ABSTRACT

An automatic door closing device for use in a sliding type door, which includes a driving section having a spiral spring disposed in a casket to urge the sliding door toward closing direction and a buffer mechanism having a cylinder and a piston for moderating closing speed of the door. The inner end of the spring is secured to a stationary shaft on which the piston is coaxially mounted. The casket containing the spring and fixing the outer end thereof and the cylinder containing the piston through an anti-rotating mechanism are integrally formed as a housing, into which lubricating oil is filled.

6 Claims, 3 Drawing Figures

AUTOMATIC DOOR CLOSING DEVICE

BACKGROUND OF THE INVENTION

This invention relates to an automatic door closing device for use in a sliding type door which is supported by and slidable between a pair of vertical frames, and more particularly to a type thereof wherein a biasing means such as a spiral spring keeps the door in closing direction thereof and a buffer mechanism comprising a cylinder and a piston is provided to moderate closing speed of the door.

Automatic door closing means have already been proposed in which spring energy accumulated in a spring member is released to close the sliding door under the control of a buffer mechanism using an air cylinder. However, such prior door closing device have their door closing performance reduced when the sliding door runs at a low speed due to the frictional resistance of the spring member. Second, such door closing devices use an air cylinder having a sliding part, for example, between the cylinder and the piston, to which foreign materials such as dust readily affix, and around which lubricating oil is readily wasted up. This results in an increase in frictional resistance to make the door closing performance hard and finally impossible. There are another problem has been raised. In case the force for opening the door is set small, the door may not be completely closed, due to the shortage of spring force, while if the closing force of the door set large, it may take much force to open the door.

SUMMARY OF THE INVENTION

It is therefore an object of the present invention to provide an improved automatic door closing device which is adapted to minimize the frictional resistance thereof to provide a high and smooth door opening and closing performance. This is accomplished in the present invention by integrally arranging the drive section having a spiral spring and the buffer section having the cylinder and the piston within the housing charged with lubricating oil such as to place the spring member and the cylinder and the piston in the lubricating oil.

DETAILED DESCRIPTION OF THE INVENTION

Figure 2:
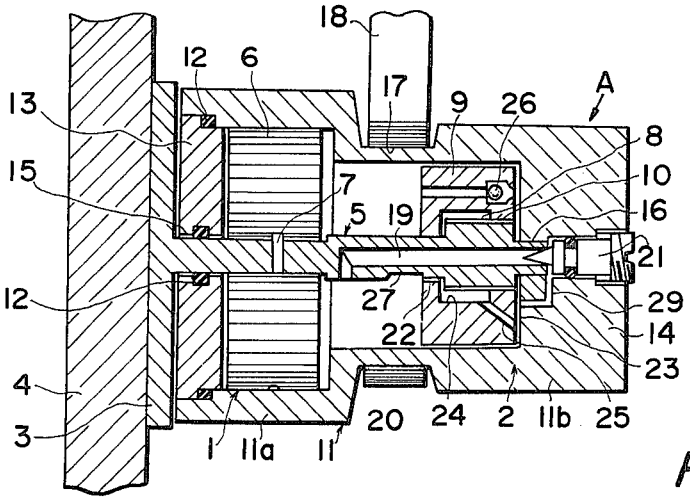
FIG. 2 shows a sectional view showing the automatic door closing device according to the present invention with the sliding door fully closed.

Referrring now to the drawins, and initially to FIG. 2 thereof, there is illustrated an automatic door closing device A for a sliding door 4 which comprisies a driving section 1 having a spring member 6 contained in a casket 11*a* and the cylinder 11*b* are formed in a unit as a housing 11, and a stationary shaft 5 is commonly used for the driving section 1 and the buffer section 2.

The housing 11 has its open end fitted through an O-ring 12 with an end plug 13 and is charged with lubricating oil. The housing 11 has also its outer periphery formed with an annular stepped portion 17 around which a belt 18 is wounded. The end plug 13 and the rear wall 14 of the housing 11 are respectively formed centrally with bores 15 and 16 adapted to bear the stationary shaft 5 to rotate the housing 11 about the stationary shaft 5. The stationary shaft 5 has at its front end a mounting portion 3 fixed to the sliding door and its rear end portion a tapped portion 8, and at its intermediate portion a recess 27. The piston 9 is coaxially mounted on the stationary shaft 5 through a prior antirotating mechanism (not shown) such that its tapped portion 10 is in engagement with the tapped portion 8 of the stationary shaft 5. The outer peripheral surface of the piston 9 is provided with a pin (not shown) to engage with a straight groove (not shown) formed in an inner periphery of the cylinder portion 11*b* of the housing 11 so as to transmit the rotation of the housing 11 to the piston 9. The spring member 6 has its inner end fixed to the stationary shaft 5 by a pin 7 and its outer end fixed to the casket 11*a* by a suitable means.

The stationary shaft 5 is formed with an oil passage 19 extending from its rear end to its intermediate portion, whose front end opens to a first chamber 20 in the cylinder and whose rear end is fitted with a needle valve 21 fitted in the rear wall 14 of the housing 11.

The inner bore of the piston 9 is defined by the tapped hole 10, a portion 22 in sliding engagement with the stationary shaft 5, and an oil passage portion 24 communicating the first chamber 20 with an second chamber 23 through an oil passage 25. The piston 9 is further formed with an oil passage communicating the second chamber 23 and the first chamber 20, in which a one way valve 26 is provided. The one way valve prevents the oil from flowing from the second chamber 23 to the first chamber 20.

Figure 1:
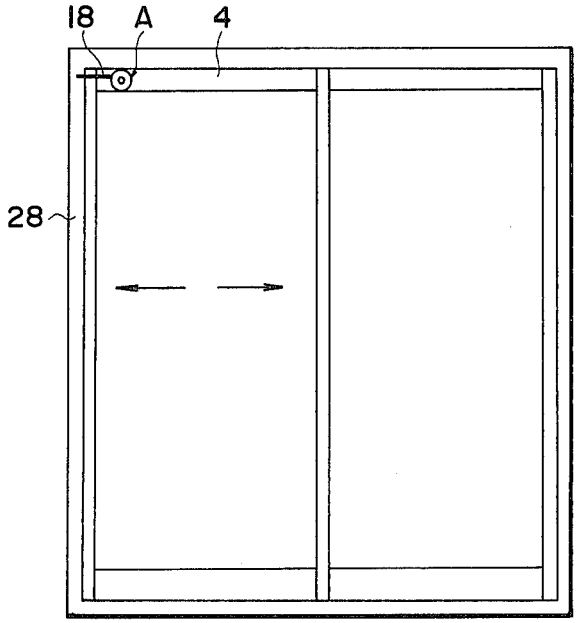
FIG. 1 shows a front view of the sliding door to which the automatic door closing device according to the present invention is attached.

As shown in FIG. 1, the automatic door closing device A is attached to the sliding type door 4 and the one end of the belt 18 is fixed to a sliding door frame 28.

Figure 3:
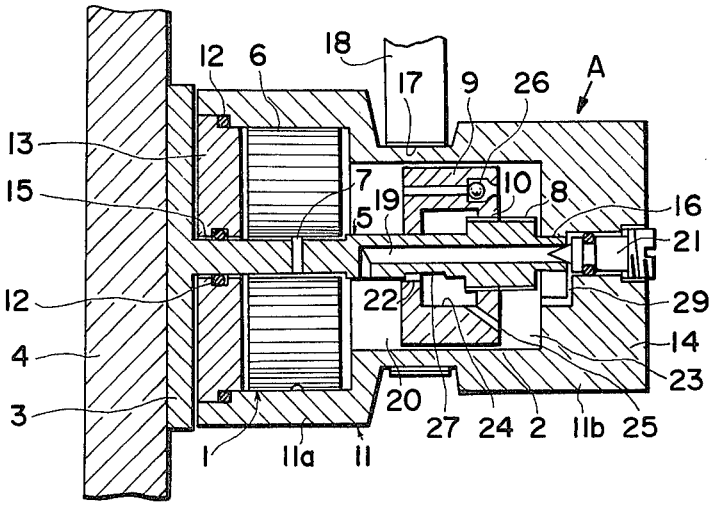
FIG. 3 shows a sectional view showing the automatic door closing device according to the present invention with the sliding door fully opened.

In operation, when the sliding door 4 is opened, the belt 18 is drawn out of the portion 17 of the housing 11, causing the housing 11 to rotate together with the piston 9, the needle valve 21 and the spring member outer end. Thus, the spring member 6 is wound tightly around the stationary shaft 5 and the piston 9 moves along the stationary shaft to the left up to the position illustrated in FIG. 3. At the time, the lubricating oil opens the one-way valve 26 and flows into the second chamber 23.

When the opened door is released, the force of the spring member 6 rotates the housing 11 in the reverse direction, causing to wind the belt 18 around the portion 17 of the housing 11. Thus, the force of the belt closes the door. At the time, the lubricating oil in the second chamber 23 flows through the oil passage 29, the needle valve 21, and the oil passage 19 into the first chamber 20. This allows the piston 9 to easily move to the right. When the engagement portion 22 reaches the recess 27 of the stationary shaft 5, the lubricating oil in the second chamber 23 flows additionally through the oil passage 25, the recess and the gap between the piston and the stationary shaft 5 into the first chamber 20 so that the amount of the lubricating oil flowing from the second chamber 23 into the first chamber 20 is increased thereby permitting the piston to move at a relatively high speed. When the engagement portion passes through the recess and comes into engagement with the true circular portion of the stationary shaft 5, the flow of the lubricating oil is made only through the needle valve and therefore, the piston moves at a lower speed thereby permitting the door to close softly.

What is claimed is:

1. An automatic door closing device for a sliding type door which is supported by and slidable between a pair of vertical frames, comprising;

(a) a stationary shaft adapted to be fixedly secured to said door, said stationary shaft being extended normally from said door when secured thereto, (b) a generally cylindrical housing rotatably supported by said stationary shaft to provide a fluid-tight annular space around said stationary shaft, (c) a biasing means housed in said housing for biasing said housing in one rotational direction, (d) a movable member housed in said housing and mounted on said stationary shaft therealong, said movable member being engaged with an inner periphery of said housing to be rotated therewith, (e) a belt having one end secured to an outer periphery of said housing and the other end adapted to be secured to one of the frames, said belt being wound normally on said outer periphery of said housing and unwound when said housing being rotated against the biasing force of said biasing means, and (f) passage means provided to permit a fluid communication between a first and a second chambers defined by opposite sides of said movable member for controlling the rotational speed of said housing in the belt winding direction.

2. An automatic door closing device as defined in claim 1, wherein said biasing means is a spiral spring and said housing comprises a casket to those said spiral spring and a cylinder to house said movable member, and said housing is filled with lubricating oil.

3. An automatic door closing device as defined in claim 1, wherein said passage means comprises;

(a) a first passage concentrically provided within said stationary shaft to permit fluid communication between said first and second chambers, (b) a second passage provided in said cylinder portion of said housing to permit fluid communication between said second chamber and said first passage, (c) a third passage provided between said movable member and said stationary shaft to permit fluid communication between said first and second chambers, said third passage being selectively opened depending upon the position of said movable member to control rotational speed of said housing in the belt winding direction, and (d) a fourth passage provided in said movable member to permit fluid commuication between said first and second chambers through said movable member.

4. An automatic door closing device as defined in claim 1, wherein said stationary shaft comprises;

(a) an enlarged diameter portion positioned at tip portion thereof, the outer periphery of said enlarged diameter portion being formed with a thread to threadingly engage with said movable member to rotatably reciprocate the same, (b) a middle diameter portion for guiding the sliding movement of said movable member, said middle diameter portion being formed with a recess to provide said third passage, and (c) a small diameter portion to wind said spiral spring therearound.

5. An automatic door closing device as defined in claim 1, wherein said movable member comprises;

(a) a female thread portion formed on one end of an inner periphery thereof to threadingly engage with said enlarged diameter portion of said stationary shaft, (b) a guide formed on the other end of said inner periphery thereof to slide on said middle diameter portion to ensure smooth reciprocating movement thereof, between said female thread portion and said guide, a space being defined, and (c) a one-way valve disposed therein to prevent said fluid from flowing from said second chamber to said first chamber, whereby when said guide is counterfaced with said recess, said third passage is opened to allow said fluid to flow from said second chamber to said first chamber to thereby increase rotational speed of said housing, and when said guide is brought into contact with the outer periphery of said middle diameter portion of said stationary shaft, said third passage is closed to block the fluid communication to thereby reducing the rotational speed of said housing.

6. An automatic door closing device as defined in claim 1, further comprising a needle valve secured in said housing in an alignment with said stationary shaft to engage with an opening of said first passage to control an amount of fluid flown from said second passage to said first passage.

* * * * *